US012110624B2

(12) United States Patent
Hsu et al.

(10) Patent No.: US 12,110,624 B2
(45) Date of Patent: Oct. 8, 2024

(54) SEWING MACHINE

(71) Applicant: ZENG HSING INDUSTRIAL CO., LTD., Taichung (TW)

(72) Inventors: Kun-Lung Hsu, Taichung (TW); Ming-Ta Lee, Taichung (TW); Wei-Chen Chen, Taichung (TW); Po-Hsien Tseng, Taichung (TW)

(73) Assignee: ZENG HSING INDUSTRIAL CO., LTD., Taichung (TW)

( * ) Notice: Subject to any disclaimer, the term of this patent is extended or adjusted under 35 U.S.C. 154(b) by 21 days.

(21) Appl. No.: 18/157,674

(22) Filed: Jan. 20, 2023

(65) Prior Publication Data

US 2024/0093416 A1 Mar. 21, 2024

(30) Foreign Application Priority Data

Sep. 21, 2022 (TW) ..... 111135749

(51) Int. Cl.
*D05B 73/12* (2006.01)

(52) U.S. Cl.
CPC ..... *D05B 73/12* (2013.01)

(58) Field of Classification Search
CPC ..... D05B 73/12; D05B 73/00; D05B 73/005
USPC ..... 112/260
See application file for complete search history.

(56) References Cited

U.S. PATENT DOCUMENTS 4,493,280 A * 1/1985 Bianchi ..... D05B 73/12 112/260
9,828,711 B2 * 11/2017 Maeda ..... D05B 73/12
2019/0352827 A1 * 11/2019 Ishikawa ..... D05B 73/12

* cited by examiner

*Primary Examiner* — Nathan E Durham
(74) *Attorney, Agent, or Firm* — Birch, Stewart, Kolasch & Birch, LLP

(57) ABSTRACT

A sewing machine includes a main body and a quick release needle plate module. The main body includes a base seat having an inner frame, and an outer case that is mounted to the inner frame and that defines an accommodating compartment. The quick release needle plate module includes a catch member, and a needle plate that covers the accommodating compartment, that is detachably pivoted to a rear section of the inner frame, and that engages the catch member. The quick release needle plate module further includes a press member inserted through the outer case and the inner frame, and operable to push the catch member to disengage the catch member. The needle plate has a plate body that covers the accommodating compartment, and a resilient member mounted between the inner frame and the plate body for driving pivot action of the plate body away from the inner frame.

7 Claims, 9 Drawing Sheets

SEWING MACHINE

CROSS-REFERENCE TO RELATED APPLICATION

This application claims priority to Taiwanese Invention Patent Application No. 111135749, filed on Sep. 21, 2022.

FIELD

The disclosure relates to a sewing machine, and more particularly to a sewing machine with a quick release needle plate.

BACKGROUND

Referring to FIG. 1, Taiwanese Invention Patent No. TW1367975B1 illustrates a conventional sewing machine 1. The conventional sewing machine 1 includes a platform 11, a needle 12 adapted to be threaded by a top thread (not shown), a feed dog (not shown) disposed on the platform 11, and a shuttle frame (not shown) mounted inside the platform 11 and accommodating a shuttle 13. The conventional sewing machine further includes a needle plate 14 that is mounted to the platform 11 via screws, and a cover plate 15 clipped onto the needle plate 14.

When the conventional sewing machine 1 needs to be serviced or maintained, it is required to first remove the needle plate 14 from the platform 11, before removing the shuttle frame and shuttle 13 so that the interior of the platform 11 may be accessed, cleaned of lint and debris, and serviced. However, because the needle plate 14 is screwed onto the platform 11 via two screws 16, a screw driver for unscrewing the screws 16 is required before the needle plate 14 may be removed from the platform 11 to thereby allow service work to be performed on the conventional sewing machine 1. Therefore, the conventional sewing machine 1 is inconvenient for users who may require routine maintenance.

SUMMARY

Therefore, an object of the disclosure is to provide a sewing machine that can alleviate at least one of the drawbacks of the prior art.

According to the disclosure, the sewing machine includes a main body and a quick release needle plate module. The main body includes a base seat, a column, and an arm. The column extends upward from the base seat, and the arm extends from an end of the column opposite to the base seat. The base seat has an inner frame, and an outer case that is mounted onto the inner frame, and that defines an accommodating compartment accommodating the inner frame. The quick release needle plate module includes a catch member, a needle plate, and a press member. The catch member is affixed to a front section of the inner frame. The needle plate covers the accommodating compartment, is detachably pivoted to a rear section of the inner frame opposite to the front section in a front-rear direction, and engages separably the catch member. The press member is inserted in the front-rear direction through a front section of the outer case and the front section of the inner frame, and that is operable to push the catch member to thereby disengage the catch member from the needle plate. The needle plate has a plate body that covers the accommodating compartment, and a resilient member mounted between the inner frame and a front section of the plate body for driving pivot action of the plate body away from the inner frame.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
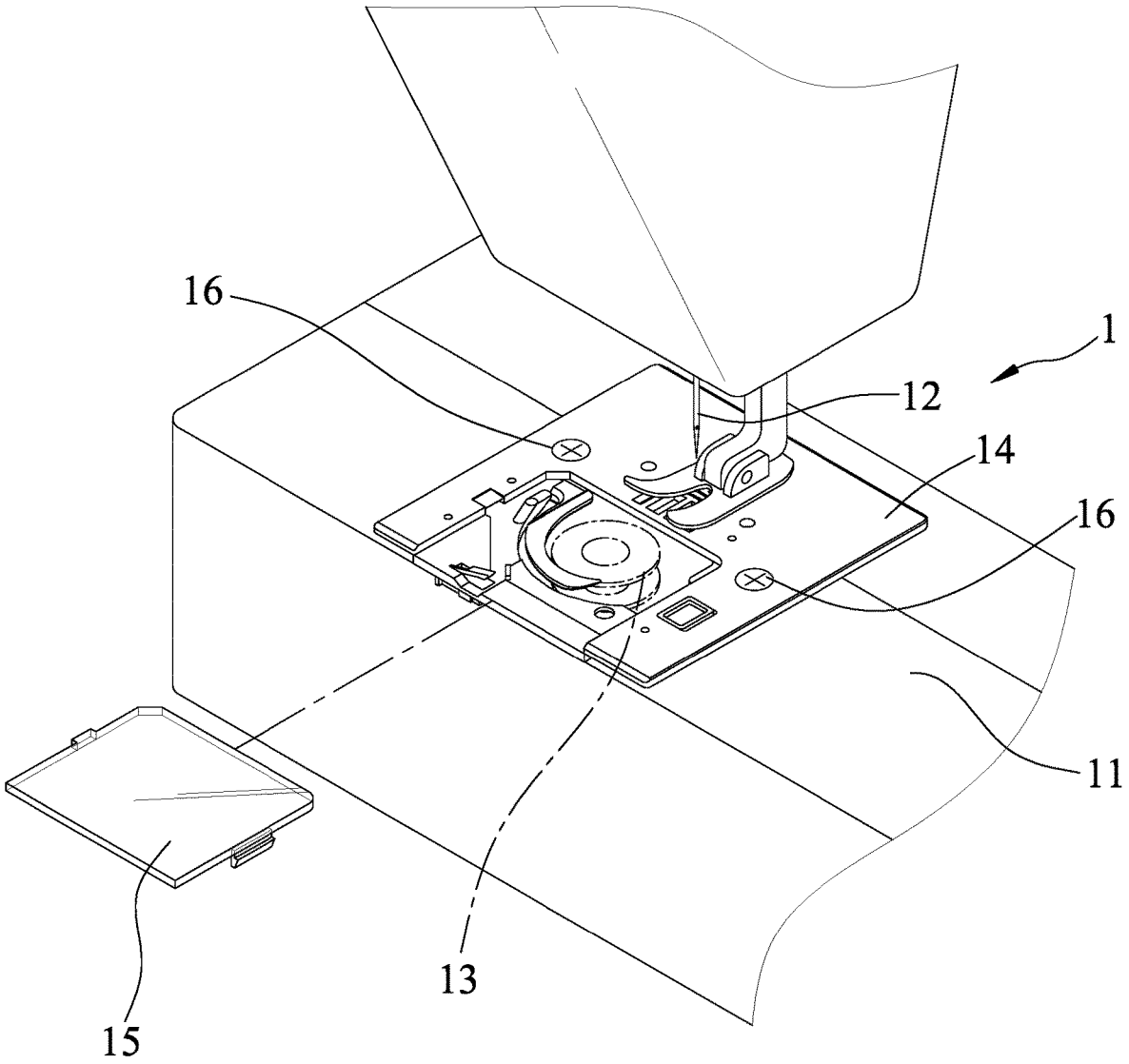
FIG.1 PRIOR ART
FIG. 1 is a fragmentary partially exploded perspective view showing a conventional sewing machine disclosed in Taiwanese Invention Patent No. TW1367975B1.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
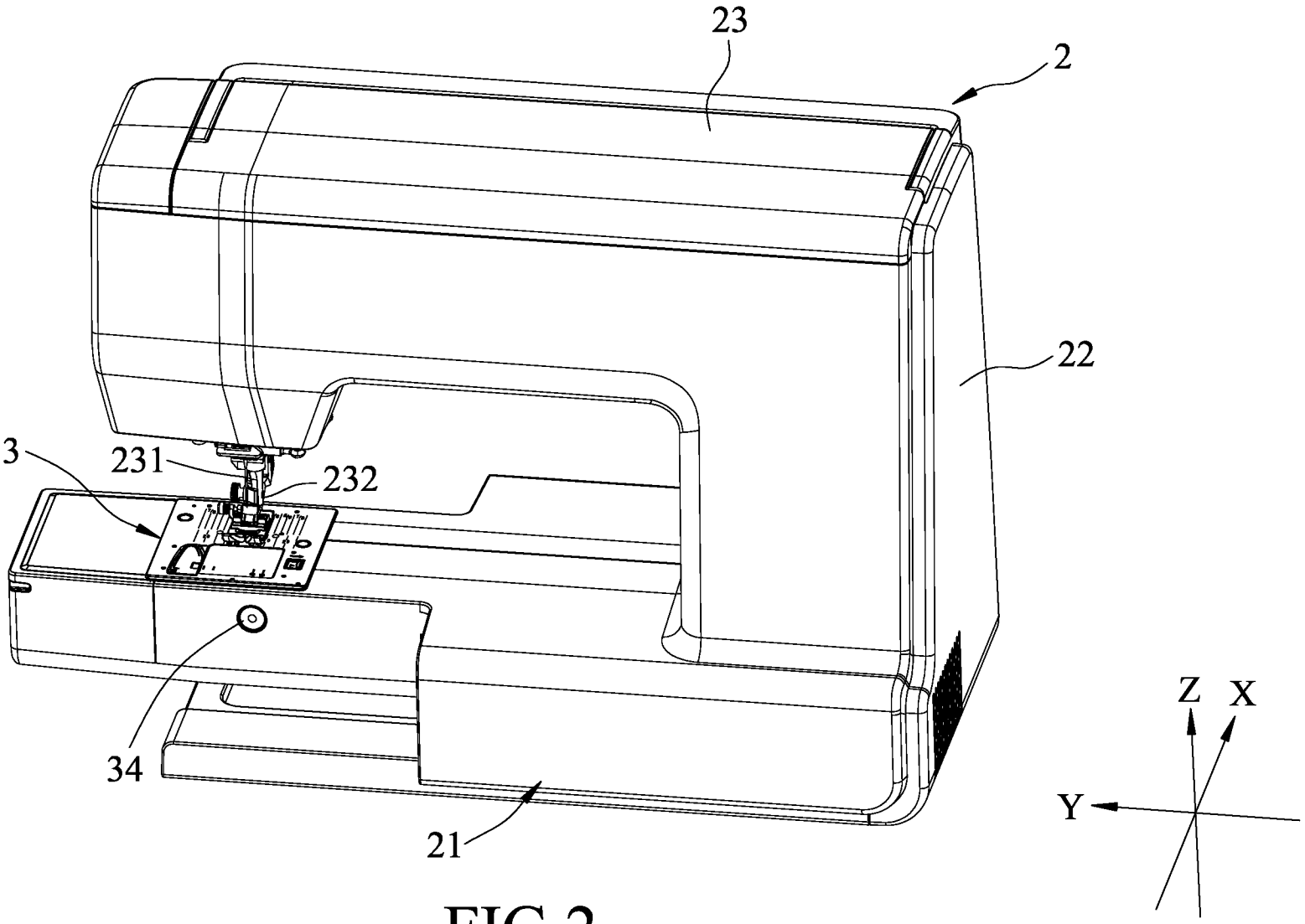
FIG. 2 is a perspective view illustrating an embodiment of a sewing machine according to the present disclosure.
Figure 3:
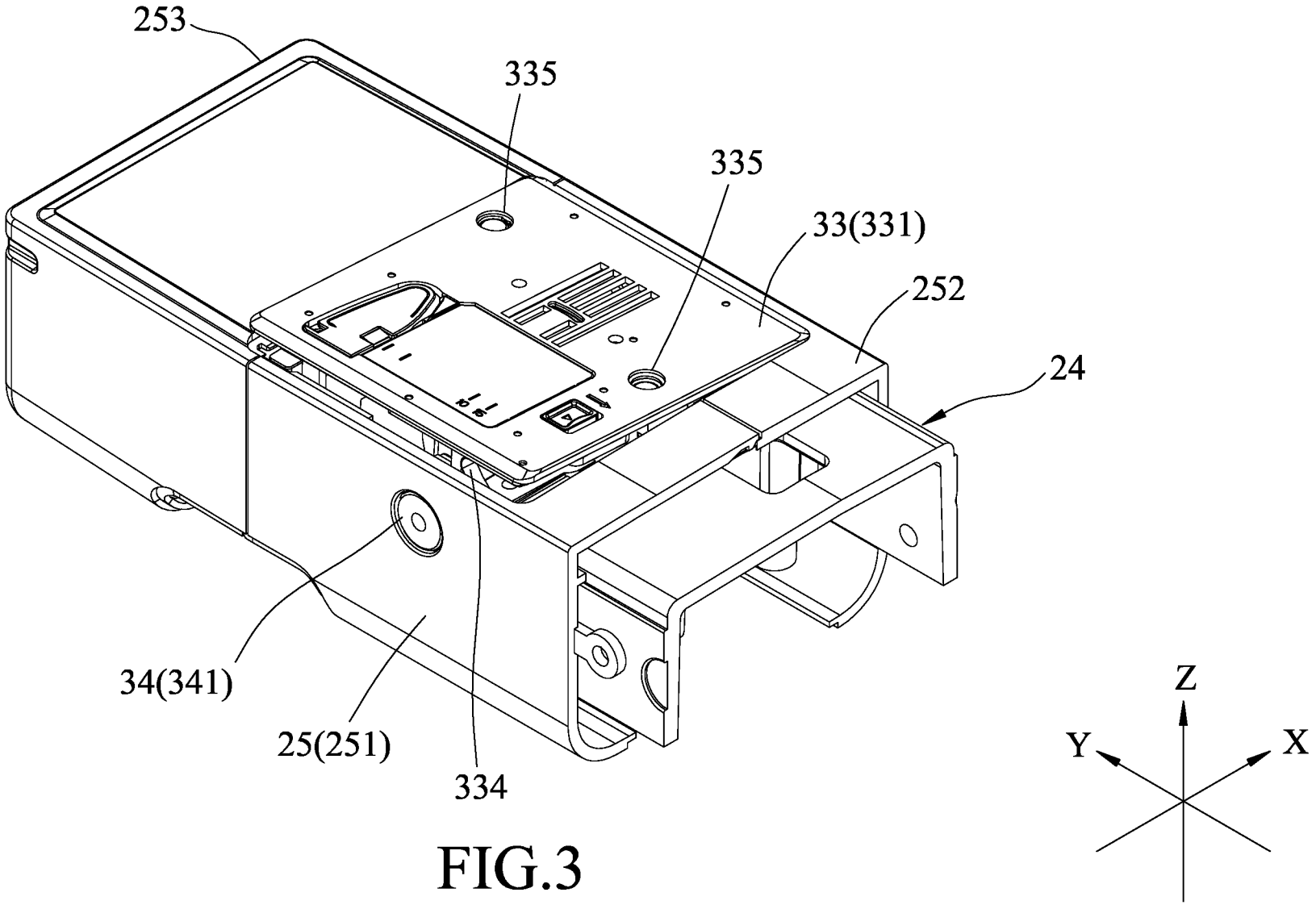
FIG. 3 is a fragmentary perspective view of the embodiment.
Figure 5:
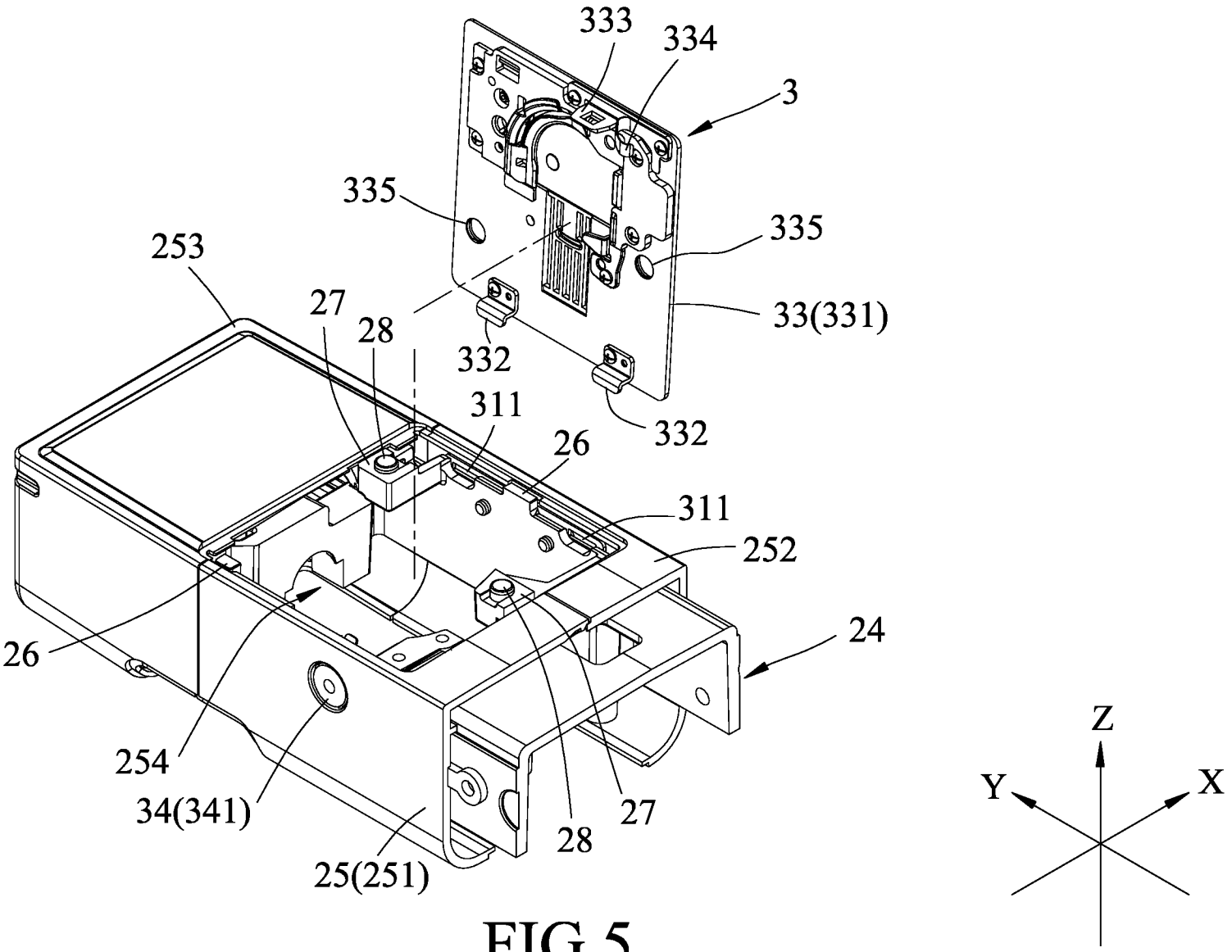
FIG. 5 is another fragmentary partially exploded perspective view of the embodiment.

Referring to FIGS. 2, 3, and 5, an embodiment of a sewing machine according to the present disclosure includes a main body 2 and a quick release needle plate module 3.

The main body 2 includes a base seat 21, a column 22 that extends upwardly from the base seat 21 in a top-bottom direction (Z), and an arm 23 that extends from an end of the column 22 opposite to the base seat 21 and that extends in a left-right direction (Y) perpendicular to the top-bottom direction (Z). In this embodiment, the arm 23 is parallel to the base seat 21. The base seat 21 has an inner frame 24 and an outer case 25 that is mounted onto the inner frame 24. The inner frame 24 accommodates a shuttle, a shuttle frame, a feed dog and various other components that a conventional sewing machine may include. However, these components are well known in the art and are not the salient aspects of the present disclosure, therefore, they are omitted in the following description. The outer case 25 has a frontal portion 251 and a rear portion 252 that are opposite to each other in a front-rear direction (X) perpendicular to the top-bottom direction (Z) and the left-right direction (Z) and that are connected respectively to front and rear ends of the inner frame 24, and a side portion 253 that is connected to a left end of the inner frame 24. The frontal portion 251, the rear portion 252, and the side portion 253 of the outer case 25 cooperatively define an accommodating compartment 254 accommodating the inner frame 24.

Figure 6:
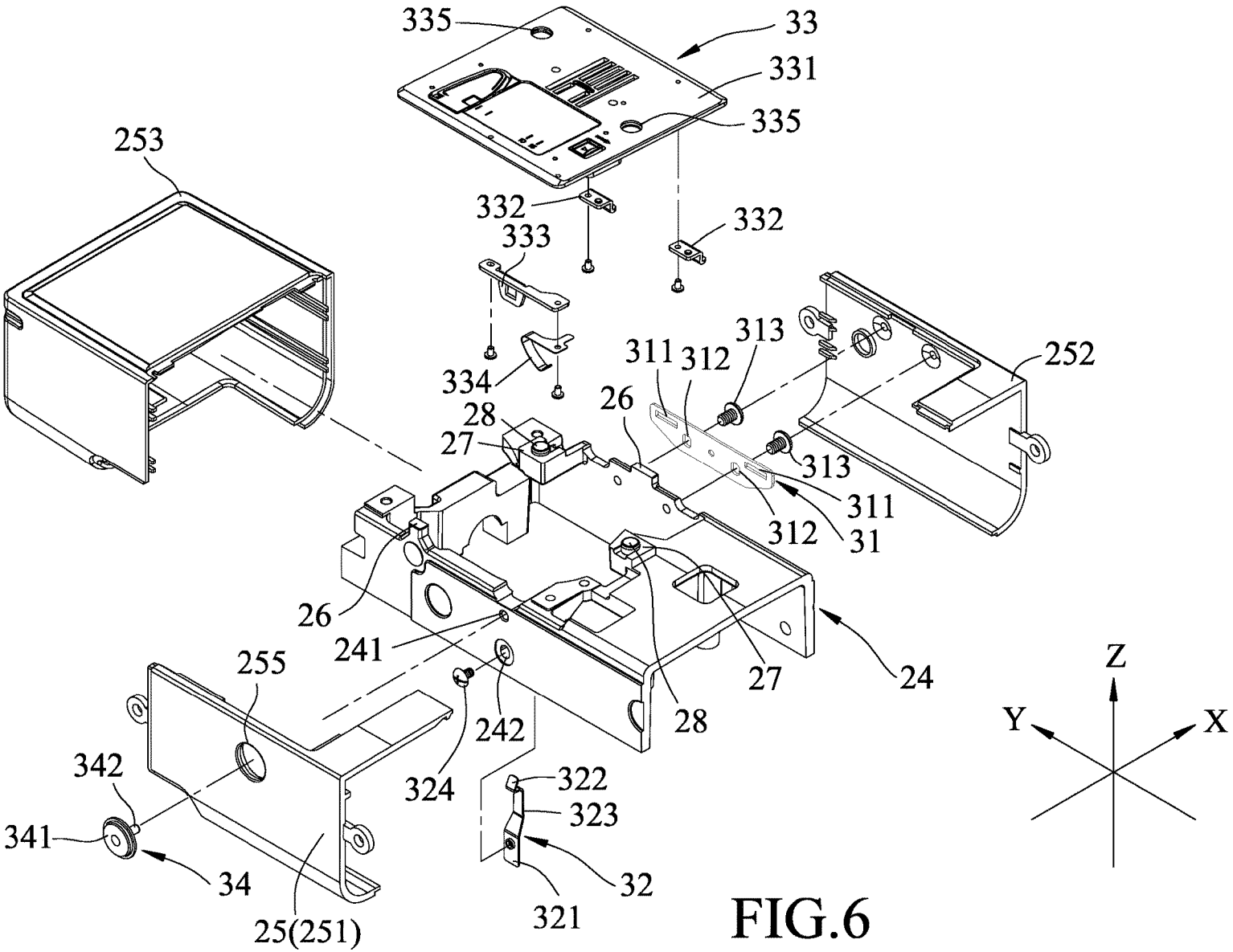
FIG. 6 is a fragmentary exploded perspective view of the embodiment.
Figure 7:
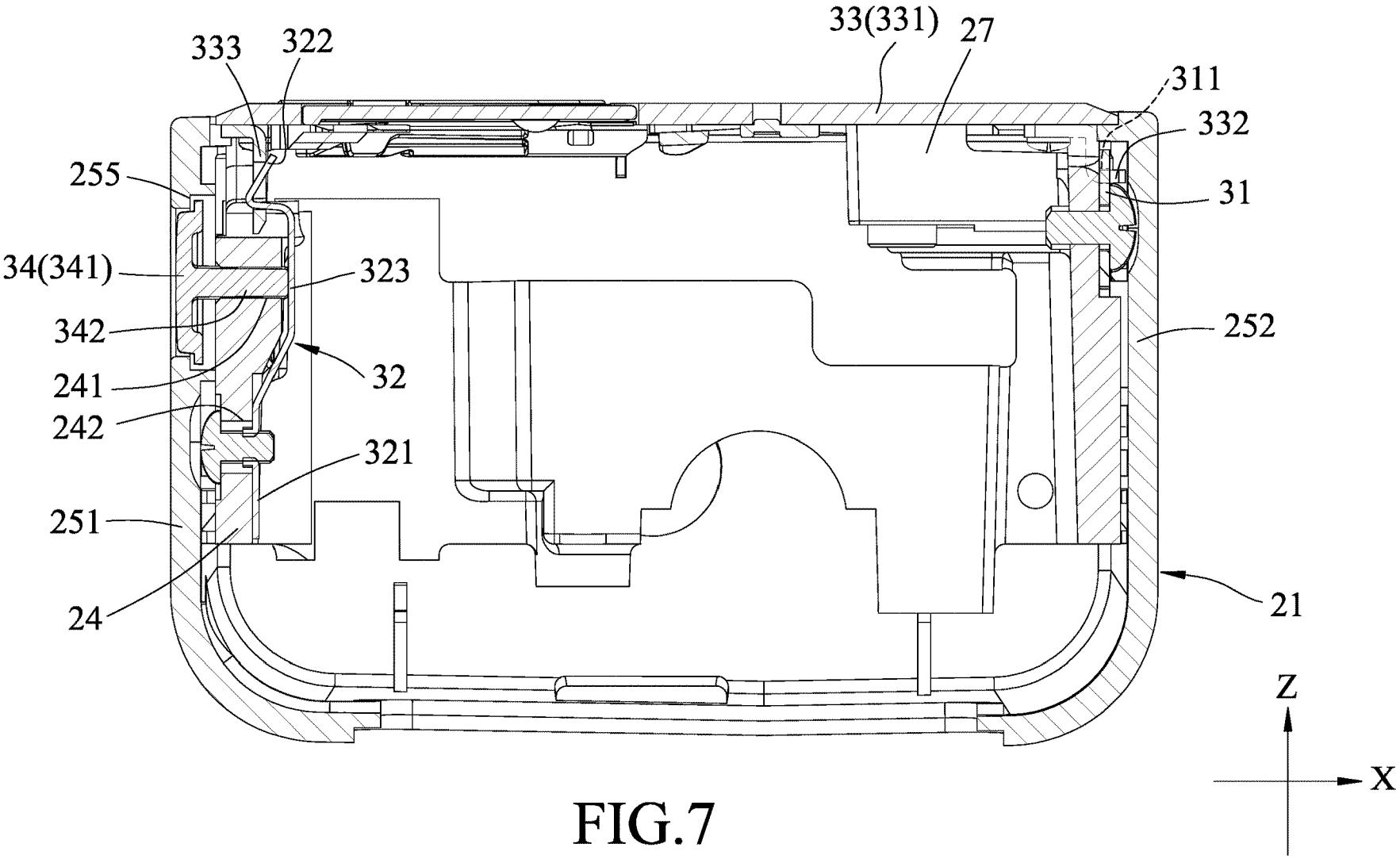
FIG. 7 is a fragmentary cross sectional view of the embodiment showing a free end of a catch member that engages with an engaging ring.

Referring to FIGS. 5 to 7, the frontal portion 251 of the outer case has a pressing hole 255 that extends in the front-rear direction (X), and that passes through the frontal portion 251. The inner frame 24 has a front section being formed with a pushing hole 241 that extends in the front-rear direction (X) and that is aligned with the pressing hole 255, and a securing hole 242 that extends therethrough in the front-rear direction (X), that is elongated in the top-bottom direction (Z), and that is positioned below the pushing hole 241. It should be noted that in this embodiment, the securing hole 242 is oval-shaped.

Referring to FIG. 2, the arm 23 has a needle bar 231 and a presser foot 232. The arm 23 has a sewing machine main shaft accommodated within, a needle driving mechanism that drives the needle bar 231 to move up and down, and a plurality of transmission components that transmit power to the needle driving mechanism and the sewing machine main shaft. However, it should be noted that since the sewing machine main shaft, the needle driving mechanism and the transmission components are well known in the art and are not the salient aspects of the present disclosure, further details of these components will be omitted in the following for the sake of clarity and brevity.

Referring to FIGS. 4 to 7, the quick release needle plate module 3 includes a coupling plate 31, a catch member 32, a needle plate 33, and a press member 34. The coupling plate 31 is affixed to a rear section of the inner frame 24. The catch member 32 is affixed to the front section of the inner frame 24. The needle plate 33 covers the accommodating compartment 254, is detachably pivoted to the rear section of the inner frame 24 opposite to the front section in the front-rear direction (X), and engages separably the catch member 32. The press member 34 is inserted in the front-rear direction (X) through a front section of the outer case and the front section of the inner frame 24, and is operable to push the catch member 32 to thereby disengage the catch member 32 from the needle plate 33.

The coupling plate 31 has two slots 311 that are spaced apart in the left-right direction (Y) and that are located above a top end of the inner frame 24, and two securing grooves 312 that are spaced apart in the left-right direction (Y), that are located below the two slots 311, and that are elongated in the top-bottom direction (Z). The quick release needle plate module 3 further includes two screws 313 that extend respectively through the securing grooves 312 and that engage threadedly the inner frame 24 to secure the coupling plate 31 to the inner frame 24. By virtue of the two securing grooves 312 being elongated in the top-bottom direction (Z), minute adjustments may be made to the positioning of the coupling plate 31 relative to the inner frame 24 in the top-bottom direction (Z). It should be noted that in this embodiment, the two securing grooves 312 are oval-shaped.

The catch member 32 has a fixed end 321 that is securely affixed to the front section of the inner frame 24, a free end 322 that is opposite to the fixed end 321 and that removably engages the needle plate 3, and an abutment section 323 that interconnects the free end 322 and the fixed end 321. The securing hole 242 corresponds in position to the fixed end 321 of the catch member 32. The quick release needle plate module 3 further includes a screw 324 that extends through the securing hole 242 and that threadedly engages the fixed end 321 of the catch member 32. By virtue of the securing hole 242 being elongated in the top-bottom direction (Z), the position to which the fixed end 321 is securely affixed to the front section of the inner frame 24 can be adjusted. In this embodiment, the free end 322 is bended to form an angle. The catch member 32 is made of a resilient material with some elasticity.

The needle plate 33 has a plate body 331, two protruding catches 332, an engaging ring 333, and a resilient member 334. The plate body 331 covers the accommodating compartment 254. The two protruding catches 332 are spaced apart in the left-right direction (Y), are disposed on a rear section of the plate body 331, and that respectively and separably engage the two slots 311. The engaging ring 333 is disposed at the front section of the plate body 331. The free end 322 is engaged removably with the engaging ring 333. The resilient member 334 is mounted between the inner frame 24 and the front section of the plate body 331 for driving pivot action of the plate body 331 away from the inner frame 24. In this embodiment, the resilient member 334 is a leaf spring mounted on the front section of the plate body 331; however, in other embodiments, other types of springs may be used and the type of spring is not a limitation of the present disclosure. Additionally, although the resilient member 334 is mounted on the front section of the plate body 331; in other embodiments, the resilient member 334 may be mounted on the inner frame 24, without affecting the ability of the resilient member 334 to drive the pivot action of the plate body 331 away from the inner frame 24.

The press member 34 has a head portion 341 that is disposed in the pressing hole 255, and a rod portion 342 that is connected to the head section 341, and that extends through the pushing hole 241. The head portion 341 is pressable to move the rod portion 342 rearward to push the catch member 32, thereby disengaging the catch member 32 from the needle plate 33.

It should be noted that the base seat 21 further has two first calibration blocks 26 that are spaced apart in the front-rear direction (X) and that extend upward from the inner frame 24, and two second calibration blocks 27 that are spaced apart in the left-right direction (Y) and that extend upward from the inner frame 24, and two positioning posts 28 that respectively extend upward from the second calibration blocks 27. The needle plate 33 further has two positioning holes 335 that are formed in the plate body 331, and that are engaged respectively and separably with the positioning posts 28. The first calibration blocks 26 and the second calibration blocks 27 have upper surfaces that are level with each other.

Figure 4:
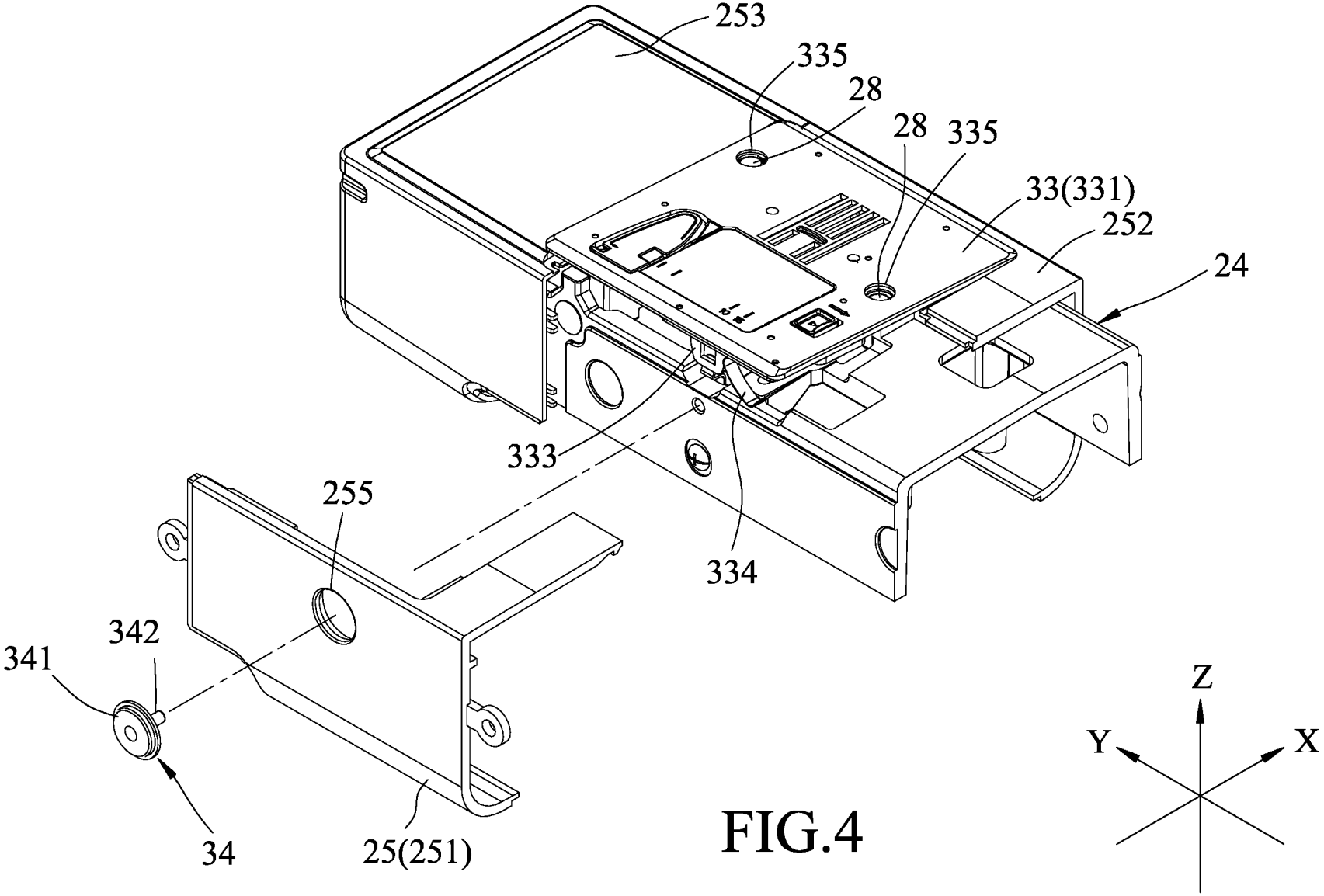
FIG. 4 is a fragmentary partially exploded perspective view of the embodiment.

Referring to FIGS. 4, 5 and 7, when the needle plate 33 is to be mounted to the base seat 21, the two protruding catches 332 are respectively engaged with the two slots 311 of the coupling plate 31, and the positioning holes 335 of the needle plate 33 are aligned with the positioning posts 28 in preparation for engagement therebetween. Next, the front section of the plate body 331 is pressed downward to compress the resilient member 334 until the plate body 331 reclines against the first calibration blocks 26 and the second calibration blocks 27 and is horizontal, and the free end 322 of the catch member 32 engages the engaging ring 333. In the sewing machine according to the present disclosure, since the positioning holes 335 are designed to allow quick alignment with the positioning posts 28, the needle plate 33 may be swiftly mounted to the base seat 21 of the main body 2 of the sewing machine.

After mounting the needle plate 33 to the base seat 21, if a user finds that the plate body 331 is not horizontal when reclining against the first calibration blocks 26 and the second calibration blocks 27, the position of the coupling plate 31 relative to the inner frame 24 may be adjusted by adjusting the positioning of the screws 313 in the top-bottom direction (Z) relative to the securing grooves 312. In this way, the user may re-position the coupling plate 31 relative to the inner frame 24 to a height that will allow the plate body 331 to recline horizontally against the first calibration blocks 26 and the second calibration blocks 27.

Figure 8:
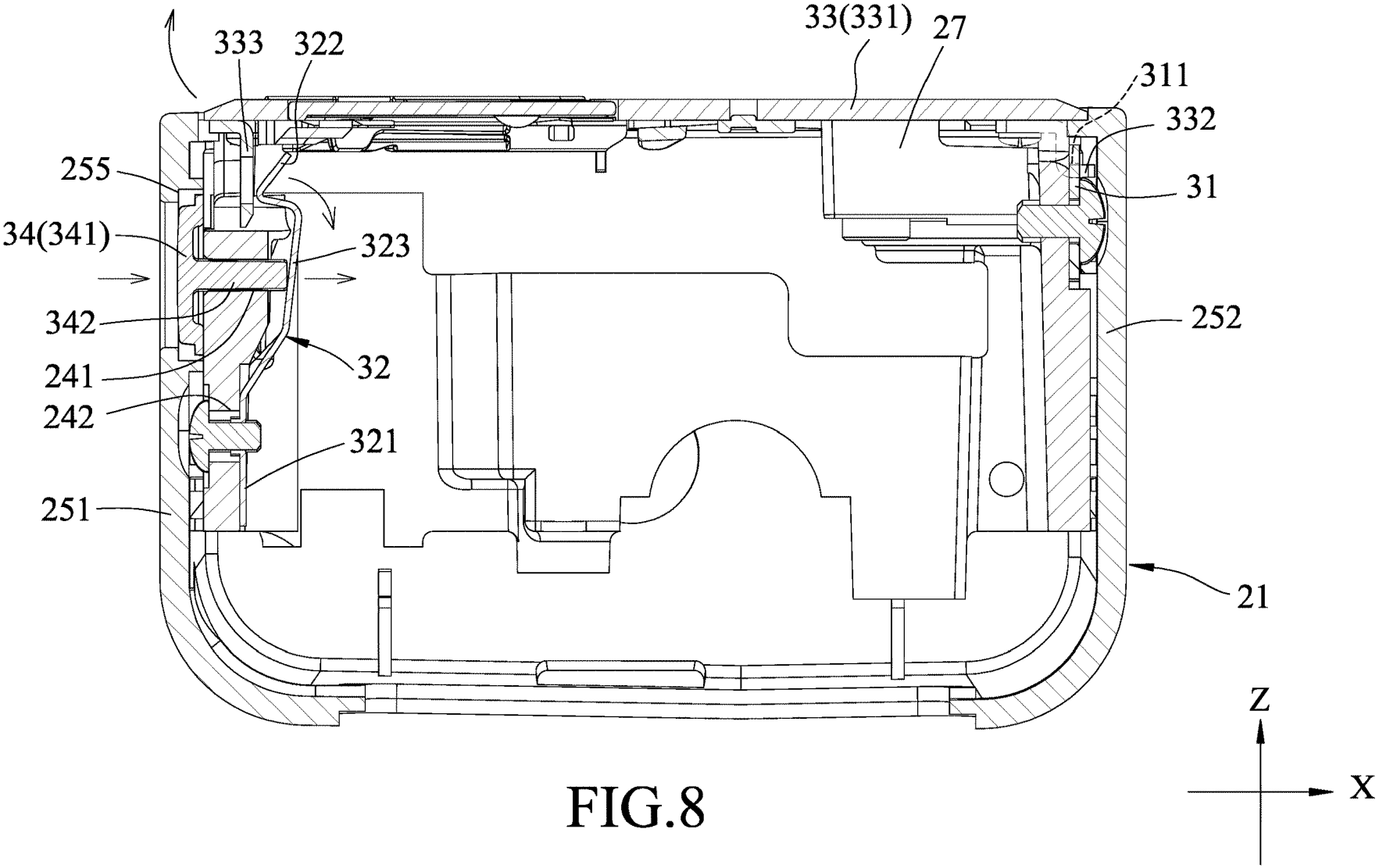
FIG. 8 is a fragmentary cross sectional view of the embodiment showing a press member that is pushed to disengage the free end of the catch member from the engaging ring.
Figure 9:
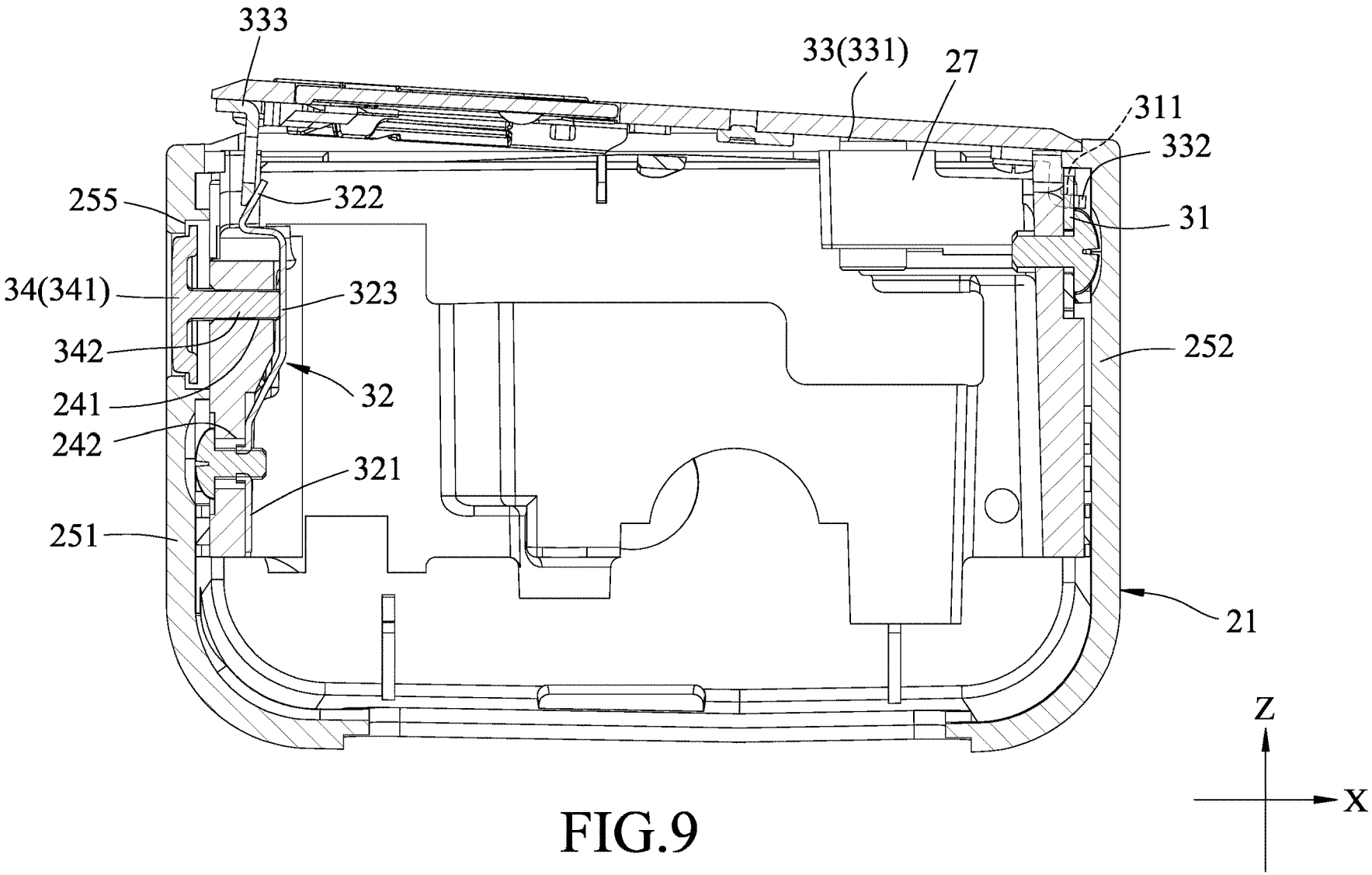
FIG. 9 is a fragmentary cross sectional view similar to FIG. 8 showing the press member pushed back by the catch member.

Referring to FIGS. 8 and 9, when the user of the sewing machine wishes to remove the needle plate 33 from the base seat 21, the press member 34 is operable to push the abutment section 323 to thereby disengage the free end 322 of the catch member 32 from the engaging ring 333 of the needle plate 33. More specifically, the head section 341 of the press member 34 is pressable by the user to move the rod section 342 rearward to push the catch member 32, thereby disengaging the catch member 32 from the needle plate 33. At this stage, a resilient force of the resilient member 334 will drive the front section of the plate body 331 to move away from the inner frame 24 in a pivot action. Since the catch member 32 is made of a resilient material, it will recover elastically to push the press member 34 back to the position shown in FIG. 9, after the free end 322 of the catch member 32 disengages from the engaging ring 333. Subsequently, the user may disengage the protruding catches 332 from the two slots 311 of the coupling plate 31 to de-mount the needle plate 33 from the base seat 21.

In summary of the above, in the sewing machine according to the present disclosure, by virtue of the protruding catches 332 that respectively and separably engage the two slots 311, the needle plate 33 may be de-mounted from the base seat 21 just by pressing the press member 34. Therefore, the user may remove the needle plate 33 without the assistance of any tools and service the sewing machine, thereby fulfilling the object of the disclosure.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A sewing machine comprising:

a main body including a base seat, a column that extends upward from said base seat, and an arm that extends from an end of said column opposite to said base seat, said base seat having an inner frame, and an outer case that is mounted onto said inner frame, and that defines an accommodating compartment accommodating said inner frame; and a quick release needle plate module including a catch member that is affixed to a front section of said inner frame, a needle plate that covers said accommodating compartment, that is detachably pivoted to a rear section of said inner frame opposite to said front section in a front-rear direction, and that engages separably said catch member, and a press member that is inserted in the front-rear direction through a front section of said outer case and said front section of said inner frame, and that is operable to push said catch member to thereby disengage said catch member from said needle plate, said needle plate having a plate body that covers said accommodating compartment, and a resilient member mounted between said inner frame and a front section of said plate body for driving pivot action of said plate body away from said inner frame;

wherein said outer case has a pressing hole;

wherein said front section of said inner frame is formed with a pushing hole that extends in the front-rear direction and that is aligned with said pressing hole;

wherein said press member has a head portion that is disposed in said pressing hole, and a rod portion that is connected to said head section, and that extends through said pushing hole; and wherein said head section is pressable to move said rod portion rearward to push said catch member, thereby disengaging said catch member from said needle plate.

2. The sewing machine as claimed in claim 1, wherein the quick release needle plate module further includes a coupling plate affixed to said rear section of said inner frame and having two slots that are spaced apart in a left-right direction perpendicular to the front-rear direction, said needle plate further having two protruding catches that are spaced apart in the left-right direction, that are disposed on a rear section of said plate body, and that respectively and separably engage said two slots.

3. The sewing machine as claimed in claim 2, wherein said coupling plate further has two securing grooves that are spaced apart in the left-right direction, and that are elongated in a top-bottom direction perpendicular to both the front-rear direction and the left-right direction, said quick release needle plate module further including two screws that extend respectively through said securing grooves and that engage threadedly said inner frame to secure said coupling plate to said inner frame.

4. The sewing machine as claimed in claim 1, wherein:

said needle plate further has an engaging ring that is disposed at said front section of said plate body; and said catch member having a fixed end that is securely affixed to said front section of said inner frame, a free end that is opposite to said fixed end and that engages removably with said engaging ring, and an abutment section that interconnects said free end and said fixed end, said press member being operable to push said abutment section to thereby disengage said free end of said catch member from said engaging ring of said needle plate.

5. The sewing machine as claimed in claim 4, wherein said front section of said inner frame is formed with a securing hole that corresponds in position to said fixed end of said catch member and that is elongated in a top-down direction perpendicular to both the front-rear direction and the left-right direction, said quick release needle plate module further including a screw that extends through said securing hole and that threadedly engages said fixed end of said catch member.

6. The sewing machine as claimed in claim 1, wherein:

said base seat further has two first calibration blocks that are spaced apart in the front-rear direction and that extend upward from said inner frame, and two second calibration blocks that are spaced apart in a left-right direction perpendicular to the front-rear direction and that extend upward from said inner frame; and said first calibration blocks and said second calibration blocks have upper surfaces that are level with each other, said plate body reclining against said first calibration blocks and said second calibration blocks and being horizontal.

7. The sewing machine as claimed in claim 6, wherein said base seat further has two positioning posts that respectively extend upward from said second calibration blocks, said needle plate further having two positioning holes that are formed in said plate body, and that are engaged respectively and separably with said positioning posts.

* * * * *